US006309270B1

(12) United States Patent
Harwell, IV et al.

(10) Patent No.: US 6,309,270 B1
(45) Date of Patent: Oct. 30, 2001

(54) SWIM GEAR

(75) Inventors: Samuel K. Harwell, IV, Nashville, TN (US); Craig C. Williamson, North Riverside, IL (US)

(73) Assignee: Big Time Toys, L.L.C., Nashville, TN (US)

( * ) Notice: Subject to any disclaimer, the term of this patent is extended or adjusted under 35 U.S.C. 154(b) by 0 days.

(21) Appl. No.: 09/364,819

(22) Filed: Jul. 30, 1999

(51) Int. Cl.[7] ..... A63B 31/00; A61F 9/02

(52) U.S. Cl. ..... 441/55; 441/57; 441/64; 2/68; 2/428

(58) Field of Search ..... 441/57, 58, 61, 441/64, 124; 2/425, 428, 68, 173, 200.2; D16/303, 311; 472/128, 133; D21/659, 660; D24/110.1, 110.2

(56) References Cited

U.S. PATENT DOCUMENTS

| | | | | |
|---|---|---|---|---|
| D. 189,181 | * | 11/1960 | Geib | D3/13 |
| 1,049,448 | * | 1/1913 | Case | 441/57 |
| 1,066,697 | * | 7/1913 | Baker | 441/57 |
| 1,093,276 | * | 4/1914 | Laser | 441/57 |
| 1,674,801 | * | 6/1928 | Schwalge | 441/64 |
| 1,761,443 | * | 6/1930 | Hooper | 428/72 |
| 1,773,440 | * | 8/1930 | Sbrolla | 441/57 |
| 2,504,524 | * | 4/1950 | Hayward | 2/445 |
| 2,705,802 | * | 4/1955 | Tellier | 2/68 |
| 2,760,201 | * | 8/1956 | Kahn | 2/68 |
| 2,950,487 | * | 8/1960 | Woods | 441/64 |
| 3,106,184 | * | 10/1963 | Shea | 116/209 |
| 3,286,287 | * | 11/1966 | Martin | 441/57 |
| 3,328,812 | * | 7/1967 | Berthiot | 441/58 |
| 3,344,449 | * | 10/1967 | Grilli | 441/60 |

(List continued on next page.)

OTHER PUBLICATIONS

Page from a catalog containing Side–Window Purge Mask and Foot–Pocket Fins.
Photo of a package from Speedo Kids Swimming Combo.
Photo of Speedo swim caps (non–characterized).
Photos of various latex rubber Halloween masks.
Masquerade mask from Rio casino advertisement.
Photo of Calypso mask and snorkel set.
Photo of Funny Face characterized swim mask with single lens.
Photo of Aqua Sphere sport water mask.

(List continued on next page.)

*Primary Examiner*—S. Joseph Morano
*Assistant Examiner*—Andrew Wright
(74) *Attorney, Agent, or Firm*—Mark J. Patterson; Wendy & Patterson; Emily A. Shouse

(57) ABSTRACT

Swim gear including a headpiece which covers the forward portion of the wearer's head and supports a pair of spaced lenses therein. A tailpiece which extends rearwardly from the forward portion of the wearer's head and terminates atop the wearer's head. An elastic band member is secured to the tailpiece and extends downwardly across the back of the wearer's head for secured relation with a connector member which is slidably carried on a head-encircling band. The head-encircling band extends around the wearer's head and has its ends secured to the headpiece adjacent each lens. The upper portion of the headpiece includes a surface for support of an appendage thereon. As a novelty feature, the appendage may be configured in the shape of the dorsal fin of a shark. Other configurations may be provided on the appendage, if desired. A pair of webbed gloves which mounts to the back of the wearer's hands is also included as a member of the swim gear of the present invention as are flippers which mount on the upper surface of the user's feet. The webbed gloves include an area on the upper surface which may be provided with a projecting member having the configuration of the dorsal fin of a shark.

6 Claims, 4 Drawing Sheets

U.S. PATENT DOCUMENTS

| | | | | |
|---|---|---|---|---|
| 3,653,086 | * | 4/1972 | Gongwer | 2/9 |
| 3,934,290 | * | 1/1976 | Le Vasseur | 441/57 |
| 4,250,584 | * | 2/1981 | Korn | 441/61 |
| 4,746,313 | * | 5/1988 | Bray et al. | 441/57 |
| 4,929,206 | * | 5/1990 | Evans | 441/64 |
| 5,855,026 | * | 1/1999 | Viola | 2/428 |
| 5,868,692 | * | 2/1999 | Michniewicz | 602/21 |
| 5,890,942 | * | 4/1999 | Souza-Ferreira et al. | 446/18 |

OTHER PUBLICATIONS

Photo of Speedo hologram goggles.
Photos of various basic swim goggles.
Font and rear photos of various masks (2 pages).
Photos of various (Speedo & Coral) swim goggles with character themes.
Photo of swim fin with exposed top of toes.
Photo of swim fins with 3 small rectangular openings for bottom of foot.
Photo of basic scuba swim fins.
Photo of swim fin with exposed top of toe.
Photo of swim fin with small hole at bottom of foot (yellow).
Photo of swim fin with small hole at bottom of foot (black).
Photo of swim fin with three small holes for bottom of feet.
Photo of basic swim fin (red).
Photo of A.P.E. webbed swim glove.
Photo of Speedo webbed swim glove.
Photo of Sprint webbed swim glove.

* cited by examiner

SWIM GEAR

FIELD OF THE INVENTION

This invention relates generally to swim gear and more particularly to specific components of the swim gear such as a lens assembly for keeping water out of the swimmer's eyes, webbed gloves to be worn on the hands, and flippers to be worn on the feet.

BACKGROUND OF THE INVENTION

Goggles are typically worn to keep water out of the eyes when used by a person swimming. The goggles typically include a pair of lenses which are positioned around the wearer's eyes and generally are held in watertight position by a single stretchable elastic band which substantially encircles the head. At least one buckle is provided on the band to adjust the band snugly around the user's head. However, the use of a single head-encircling band has been known to be bothersome since the goggles have a tendency to slip downwardly during diving and swimming. Applicant's device overcomes this problem by providing an assembly which includes a headpiece having a forward surface which is provided with a pair of spaced lenses secured therein. The headpiece also includes an intermediate section having converging sides which terminate at a tail-end section which is supported at the top of the wearer's head when being worn. A head-encircling band which encircles the head substantially at eye level is provided, and, a retention band which has one end connected to the tail end of the headpiece and the other end connected to the head-encircling band secures the head-encircling band from slipping downwardly while the wearer is swimming or driving. Alternate constructions of the retaining bands could include bands that criss-cross, one band extending from the upper left side of the mask to the lower right and another extending from the upper right side of the mask to the lower left. Yet another option would be to have the second strap extend from one side of the mask to the other but looped through rear tip of the tail-end section. The headpiece is a unitary member made of soft, pliable plastic. Alternatively, the intermediate section can be made of a more rigid piece of material and eliminate the need for the retention band. Other alternative constructions can be used without departing from the spirit and scope of the invention. As a novelty feature, which is particularly pleasing to children, the outer upper surface of the intermediate section may support an appendage or protrusion resembling the dorsal fin of a shark or the protrusion may resemble a comb to look like a "sea creature." The comb as referred to herein may resemble the red outgrowth on the top of the head of a rooster to provide the appearance of a "sea creature." Other configurations may be used, if desired.

The swim gear of the present invention also contemplates the provision of a pair of gloves to be worn on the hands of the user to enable the user to swim faster (only one glove is shown). The gloves function as a paddle when worn and used while the wearer is swimming. The gloves are made of semi-rigid plastic and are provided with a webbed structure and are worn only on the back of the hands. No portion of the gloves is engaged by the palm of the hand. This construction allows the glove to fit various sizes of hands, makes gripping floats and rails easier, is cooler in the hot summer and has other advantages. The gloves are worn on the upper surface of the hands and include downwardly depending ring-like members having oval finger and thumb openings to receive the fingers and thumb of the wearer. An elastic band is provided on the bottom of the gloves to encircle the wrist of the user. The elastic band and oval openings secure the gloves to the user's hand. As a novelty feature, which is particularly pleasing to children, the upper surface of the glove may be provided with a fin-like protrusion which approximates the configuration of the dorsal fin of a shark, or, if desired, the protrusion may be in the form of a "rooster comb" to approximate the appearance of a "sea creature." Other configurations may be used, if desired.

The present invention also includes the provision of flippers which are worn on the feet to increase the speed of the swimmer. Typical known flippers include upper and lower spaced surfaces forming a space therebetween. The foot is positioned in the space between the upper and lower surfaces. An opening at the rear of the flippers communicate with the space between the upper and lower surfaces and enables the wearer to insert the foot through the opening and into the space between the upper and lower surfaces. The flippers of the present invention in contrast are wearable on the top surface of the feet and have no surface which engages the underside of the feet. The present flippers are attached to the upper surface of the foot of the user by a pair of adjustable straps mounted on the bottom inner side surface of the flippers. The first strap is adjustably mounted on the bottom side surfaces of the flippers and extends between the sides to encircle the bottom surface of the foot adjacent the arch of the foot. The second strap is secured between the bottom side surfaces and extends around the back of the heel of the user. The flippers help the wearer to swim faster. The novel construction of the flippers, however, makes them universally wearable regardless of the size of the foot of the person wearing them. The unique construction provides traction between the wearer's foot and a surface on which the wearer is walking and allows the size of the flipper to be adjusted to fit anyone, regardless of the size of their foot.

SUMMARY OF THE INVENTION

It is an object of the present invention to provide swim gear for enhancing the swimming pleasure of the wearer.

It is another object of the present invention to provide such swim gear with a headpiece having lenses mounted therein and fastening means for fastening the headpiece on the head of a wearer.

It is still another object of the present invention to provide webbed gloves for mounting to the back surface of the hand of the wearer to enable the wearer (swimmer) to swim faster by using the webbed feature as a paddle.

It is yet another object of the present invention to provide flippers for mounting to the upper surface of the user's foot for enabling a swimmer to swim faster.

DESCRIPTION OF THE PREFERRED EMBODIMENTS

Figure 1:
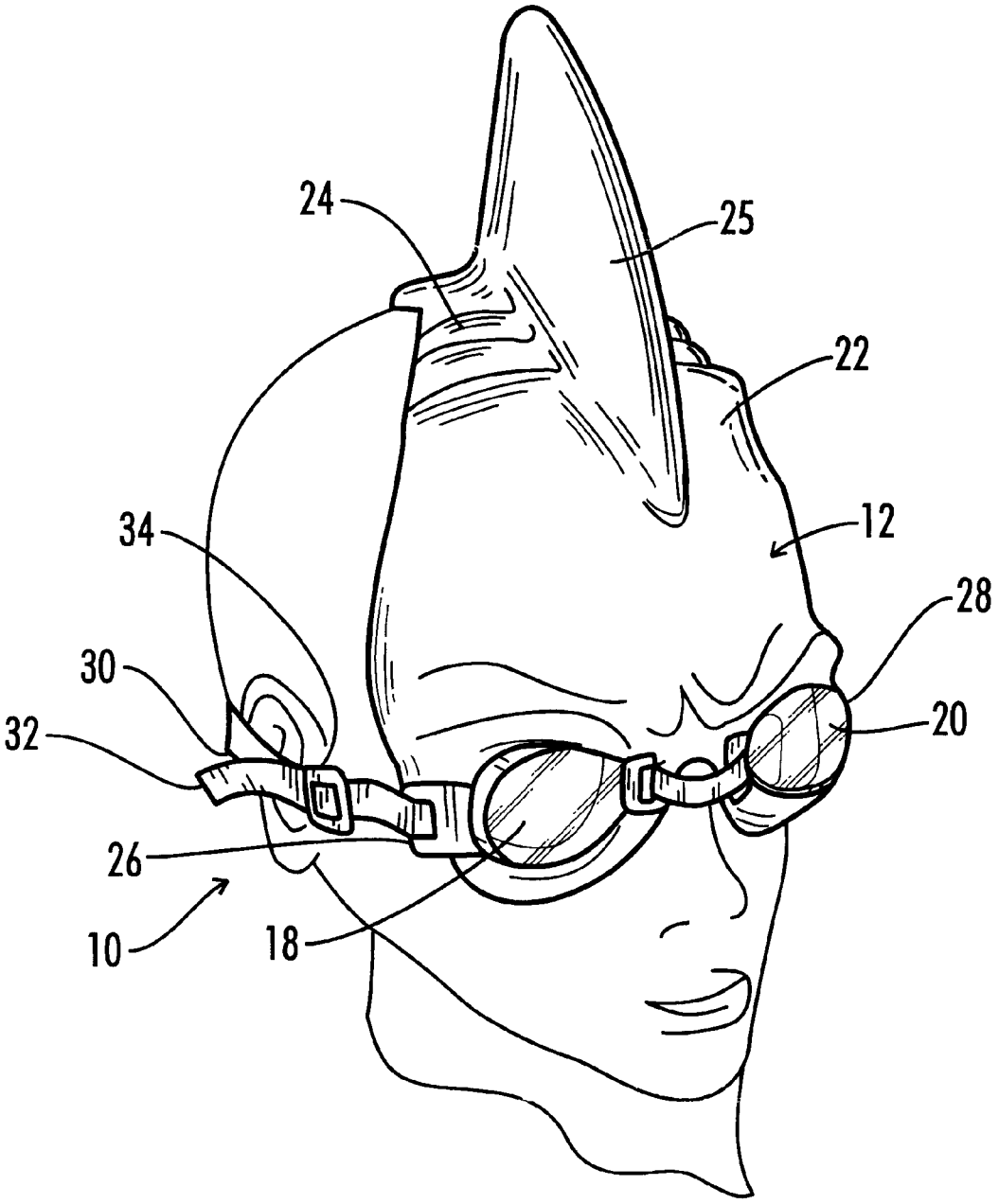
FIG. 1 is a side pictorial view of the headpiece of the present invention. The headpiece is shown to include lenses supported in a forward portion of the headpiece. A protrusion is shown extending upwardly from an upper outer surface of the headpiece in the configuration of a shark's dorsal fin.
Figure 2:
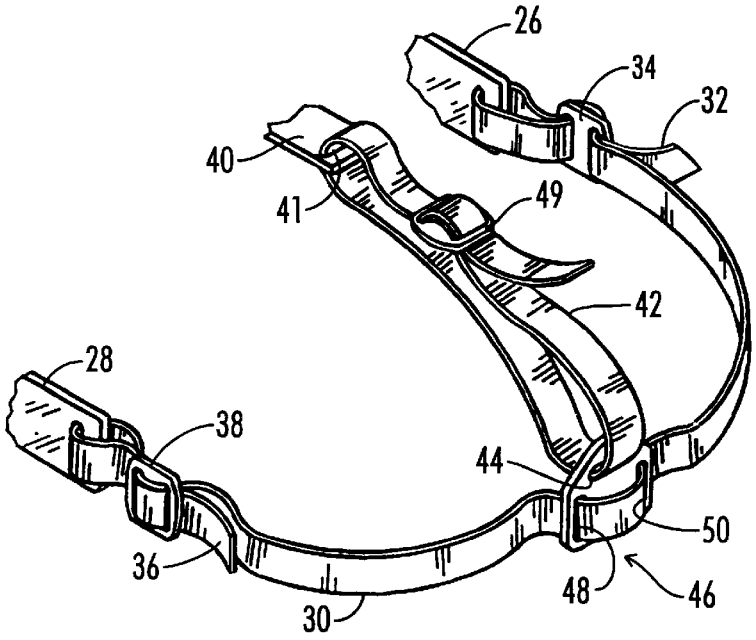
FIG. 2 is a diagrammatic pictorial view illustrating the elastic bands for securing the head including the lens assembly to the user's head.
Figure 4:
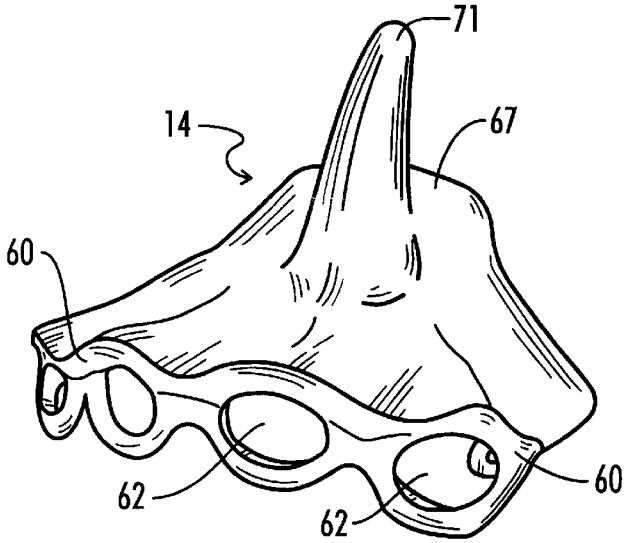
FIG. 4 is a pictorial view of a glove for secured relation to the back of the hand of the user. As a novelty feature, a protrusion on the upper surface of the glove is disposed to resemble the dorsal fin of a shark.
Figure 6:
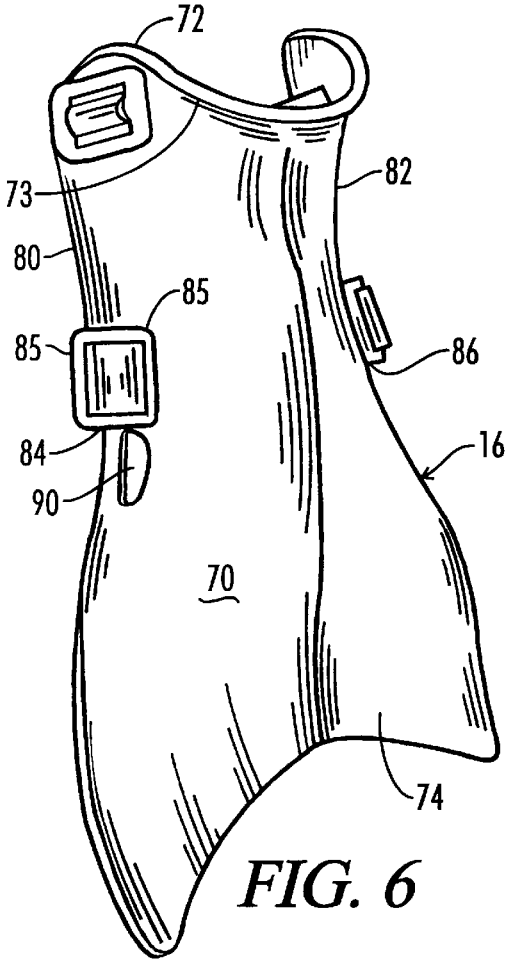
FIG. 6 is a top pictorial view of the flippers which are worn on the feet of the user. The fins include enlarged end which enables the swimmer to swim faster.
Figure 8:
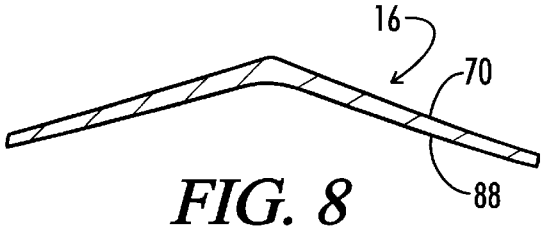
FIG. 8 is a sectional view taken along line 8—8 of FIG. 7.

The FIGS. 1, 4, and 6 illustrate the swim gear of the present invention to include a headpiece 12, a webbed glove 14, and a flipper 16. As seen in FIG. 1, headpiece 12 includes a pair of lens 18 and 20 mounted in a forward portion 22 thereof. Secured on the outer edge of each lens 18 and 20, respectively, are outwardly extending members 26 and 28 to which opposite ends of an elastic head-encircling band 30 are attached. One end 32 of band 30 extends through outwardly extending member 26 and folds back through a buckle 34 slidably mounted on band 30. The second end 36 of band 30 extends through outwardly extending member 28 and folds back through a buckle 38 which is slidably mounted on band 30 (FIG. 2).

Figure 3:
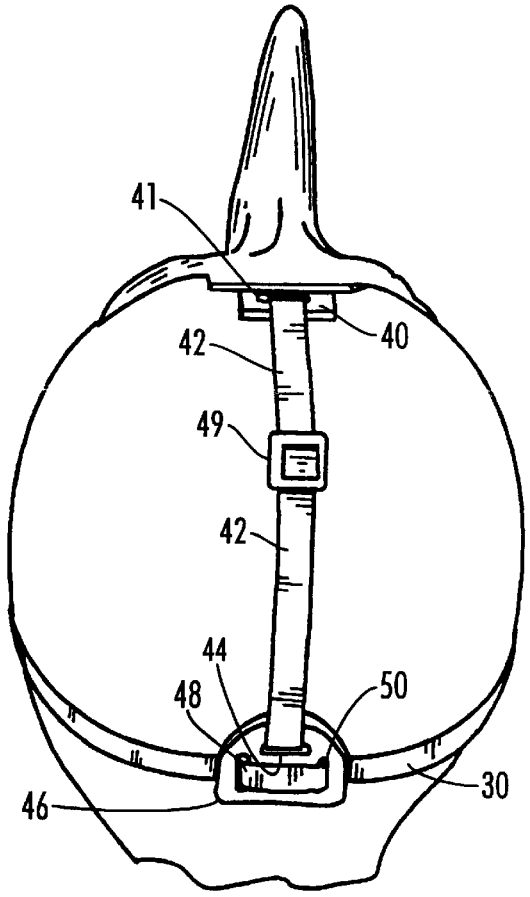
FIG. 3 is a rear view of the elastic bands of FIG. 2 mounted on the head of the wearer.

As seen in FIG. 1, the headpiece includes forward portion 22 and an intermediate portion 24 which extends rearwardly from forward portion 22 and terminates at a tail section 40 (FIGS. 2 and 3) of the headpiece and is disposed to rest on the top of the head of the user. The tail section 40 is provided with an opening 41 through which an elastic strap 42 is attached. Strap 42 is in the form of a loop and extends through an opening 44 in a coupling member 46 and is adjustably attached between the coupling member 46 and the tail section 40 of the headpiece by a buckle 49. Coupling member 46 includes a pair of openings 48 and 50 through which the head-encircling band 30 extends for slideable relation of the coupling member on the head-encircling band 30. The band 30 and strap 42 comprise retaining means to hold the mask in place. The retaining means can take other forms, including criss-crossed straps, having the intermediate section formed of a more rigid material, having the strap extend from one side of the mask to the other with the strap connected to the tail section 40, and similar means.

A projection 25 is formed or mounted on the intermediate section 24 of the headpiece. As a novelty feature which is particularly pleasing to children, the projection resembles the dorsal fin of a shark and provides the appearance of a shark when the wearer's head is mostly submerged.

Figure 5:
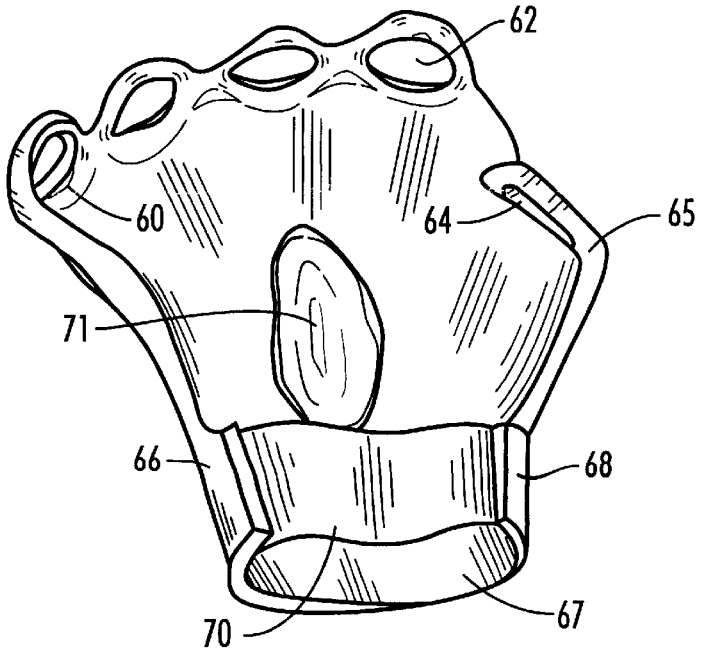
FIG. 5 is a perspective bottom view of the glove of FIG. 4 illustrating the bottom surface of the glove. Downwardly projecting finger engaging elements are shown. The user's fingers and thumb are inserted in the holes of the finger engaging members. An elastic band for securing the glove to the inner wrist portion of the band is illustrated.

A pair of gloves 14 (one shown) is contemplated as forming a part of the swim gear of the present invention. The gloves act as paddles and enables the user to swim faster. The gloves are worn on the outer (top) surface of the wearer's hand. One glove is shown and is identified by the numeral 14 in FIGS. 4 and 5. As seen in FIGS. 4 and 5, the glove is a unitary structure which is provided with downwardly depending members 60 in the shape of ringlets having oval openings 62 therein to receive the fingers of the wearer. An oval opening 64 (FIG. 4) is provided in a downwardly depending member 65 to receive the thumb of the wearer. The glove is provided on the upper, outer back portion 67 thereof with a pair of downwardly depending portions 66 and 68 (FIG. 5) and an elastic band 70 is connected between portions 66 and 68. This structure enables the wearer to slip his or her hand under band 70. In this position, the wearer's fingers extend through the openings 62 and 64 and the band extends across the inner surface of the wearer's wrist. A fin-like protrusion 71 which approximates the configuration of a dorsal fin of a shark is shown on the back surface of the gloves.

Figure 7:
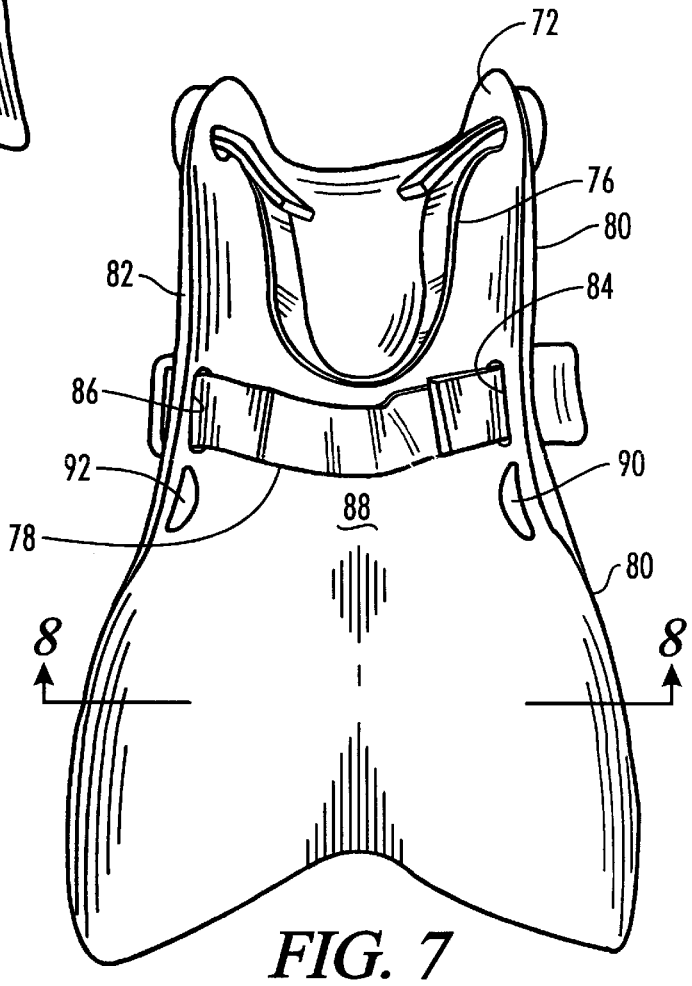
FIG. 7 is a bottom view of the flipper shown in FIG. 6 and illustrates the elastic bands which secure the flipper to the wearer's feet.

FIGS. 6 and 7 are top and bottom views of the flippers of the present invention. As seen in FIG. 6, a flipper 16 is shown to have an upper surface 70 longitudinally extending between an up-turned rear arcuate end portion 73 and a forward portion 74. A pair of stretchable straps 76 and 78 (FIG. 7) extends between downwardly extending sides 80 and 82 of flipper 16. Stretchable strap 78 extends through a pair of openings 84 and 86 of the sides 80 and 82 and are adjustably attached to the sides of the flipper by buckles 85 and 86.

As more clearly seen in FIG. 7, the body of the flipper is provided with an upwardly curved, inner surface 88 and arcuate rear inner surface 72. Strap 76 is disposed to encircle the heel of the wearer and strap 78 fits around the foot of the wearer adjacent the arch of the wearer's foot. To place the flipper on the wearer it is only necessary that the wearer slide his foot through the inner surface of the flipper and band 78 and then stretch band 76 around the heel of the wearer. A pair of additional holes 90 and 92 is provided in side surfaces 80 and 82 for the band 78 to be moved to and thus accommodate a larger foot. The bottom of the flipper is open to allow the bottom of the user's foot to directly contact the ground upon which the user is walking. Better traction is thus achieved by the flippers of the present invention.

Figure 9:
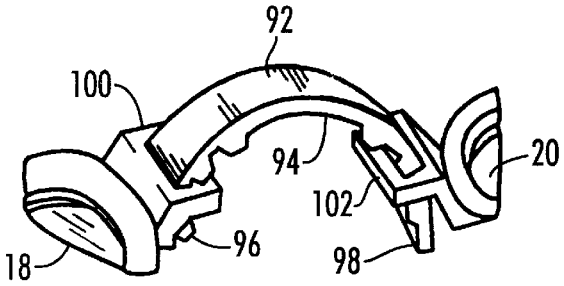
FIG. 9 is a pictorial view of a member which is used to adjust the spacing between the lenses.

As seen in FIG. 9, the spacing between the lenses may be made adjustable by a flexible plastic member 92 which is secured on the inner periphery of each lens. The plastic member 92 includes an inner toothed surface 94 and ends 96 and 98 which extend through openings in outwardly projecting members 100 and 102 formed on the inner periphery of the lenses. Member 92 is moved through outwardly projecting members 100 and 102 for engagement of a selected serration with the inner surface of projecting members 100 and 102.

A feature and advantage of the present invention is the combination of a mask (headpiece) having water tight lenses mounted therein. The headpiece covers only a small portion of the top of the user's head.

Another feature of the present invention is that the headpiece 4 does not entirely cover the user's head (as a full swim cap does), but leaves the side of the head exposed to the atmosphere. Such structure provides a degree of comfort to the user since his or her head will not be completely enclosed and subjected to heat build up.

Still another feature of the present invention is that the "one size fits all" characterization may apply to each component of the invention since each component has an openness not found in the prior art.

It is to be understood that each component, i.e., headpiece, gloves, and flippers combine to enhance the swimming pleasure of an individual. The headpiece structure prevents the wearer from having to continuously reposition the eyepieces for watertight fitting of the lenses. The gloves and flippers produce a paddling effect to allow the wearer to swim faster.

What is claimed is:

1. Swim gear to enhance the swimming pleasure of a wearer comprising:

a headpiece having a pair of spaced lenses mounted therein, first retaining means for retaining said lenses snugly against the face of the wearer, and second retaining means disposed in secured relation with said headpiece and said first retaining means to prevent downward displacement of said first retaining means;

webbed gloves for mounting to the back surface of the hands of a wearer to function as a paddle and thus increase the swimming speed of a wearer; and flippers disposed for mounting on the top surface of the feet of a wearer to increase the swimming speed of a wearer, wherein said gloves are provided with inner and outer surfaces, said inner surface of said glove including a plurality of members depending therefrom, said members having openings therein to receive a wearer's fingers and thumb and wherein said gloves include a front and a rear portion, said rear portion having a pair of downwardly projecting end members, and a band extending therebetween in secured relation thereto, said band disposed to secure said glove on the wrist of a wearer between said downwardly projecting end members of said rear portion of said glove.

2. Swim gear as in claim 1, wherein said gloves are webbed at said front portion thereof.

3. Swim gear to enhance the swimming pleasure of a wearer comprising:

a headpiece having a pair of spaced lenses mounted therein, first retaining means for retaining said lenses snugly against the face of the wearer, and second retaining means disposed in secured relation with said headpiece and said first retaining means to prevent downward displacement of said first retaining means;

webbed gloves for mounting to the back surface of the hands of a wearer to function as a paddle and thus increase the swimming speed of a wearer; and flippers disposed for mounting on the top surface of the feet of a wearer to increase the swimming speed of a wearer, wherein said flippers are unitary members having a webbed upper section, a pair of downwardly depending side members and an open bottom with a first band extending between said side members for engagement with a wearer's foot adjacent the arch thereof.

4. Swim gear as in claim 3, including a second band secured to said downwardly depending sides, said second band disposed for engaging the heel of a wearer's foot responsive to insertion of the foot between said webbed upper section, said downwardly depending side members, and said first band.

5. Swim gear as in claim 4, wherein said first and second bands are provided with fastening means for adjusting the tension of said bands.

6. Swim gear including flippers to be worn on the top of the feet of a swimmer, each flipper comprising a unitary structure having a blade and an upper-foot portion with an open bottom, each flipper further comprising at least one strap attached to the unitary structure for securing the flipper to the bottom of the swimmer's foot and wherein only the strap is in contact with the bottom of the swimmer's foot when the flipper is worn.

* * * * *